US011319025B2

(12) United States Patent
Matthews

(10) Patent No.: US 11,319,025 B2
(45) Date of Patent: May 3, 2022

(54) MARINE VESSEL HULL WITH A LONGITUDINALLY-VENTED, PARTIAL-BEAM TRANSVERSE STEP

(71) Applicant: Cross Step LLC, Yeadon, PA (US)

(72) Inventor: Stephen Daniel Matthews, Stuart, FL (US)

(73) Assignee: Cross Step LLC, Yeadon, PA (US)

( * ) Notice: Subject to any disclaimer, the term of this patent is extended or adjusted under 35 U.S.C. 154(b) by 0 days.

(21) Appl. No.: 16/930,752

(22) Filed: Jul. 16, 2020

(65) Prior Publication Data

US 2020/0361567 A1 Nov. 19, 2020

Related U.S. Application Data

(63) Continuation-in-part of application No. 16/851,506, filed on Apr. 17, 2020.

(60) Provisional application No. 62/879,025, filed on Jul. 26, 2019, provisional application No. 62/835,650, filed on Apr. 18, 2019.

(51) Int. Cl.
*B63B 1/04* (2006.01)

(52) U.S. Cl.
CPC ..... *B63B 1/042* (2013.01)

(58) Field of Classification Search
CPC ..... B63B 1/042; B63B 2001/201; B63B 1/20; B63B 2001/202; B63B 1/38; B63B 1/10; B63B 2001/387; Y02T 70/122
See application file for complete search history.

(56) References Cited

U.S. PATENT DOCUMENTS

| | | | |
|---|---|---|---|
| 1,050,517 | A | 1/1913 | Chase |
| 1,935,622 | A | 11/1933 | Eddy |
| 2,044,771 | A | 6/1936 | Carr |
| 3,113,543 | A | 12/1963 | Brownback |
| 3,237,581 | A | 3/1966 | Moesly |
| 3,316,874 | A | 5/1967 | Canazzi |
| 3,604,385 | A | 9/1971 | Reider |

(Continued)

FOREIGN PATENT DOCUMENTS

| | | | |
|---|---|---|---|
| GB | 2069415 | A | 8/1981 |
| KR | 20070045886 | A | 5/2007 |

OTHER PUBLICATIONS

Peters, M., "Peters on (Fast) Powerboats—Part 2," Nov./Dec. 2010, pp. 56-71, Professional BoatBuilder, URL: https://proboat.com/wp-content/uploads/2011/04/hispeedpower127low.pdf.

(Continued)

*Primary Examiner* — Anthony D Wiest
(74) *Attorney, Agent, or Firm* — RatnerPrestia

(57) ABSTRACT

A marine vessel hull, and marine vessels comprising at least one such hull, comprising a non-entrapment hull having at least one partial-beam, longitudinally vented transverse step, each partial-beam, longitudinally vented transverse step comprising a transverse step with port and starboard portions that do not continuously extend from port chine to starboard chine. In one embodiment, the port and starboard portions extend inwardly to an intersection with at least one longitudinal step but do not fully extend from starboard to port across the full beam of the vessel. In another, the port and starboard portions extend between longitudinal steps across the centerline but not to the starboard and port chines.

34 Claims, 15 Drawing Sheets

(56) References Cited

U.S. PATENT DOCUMENTS

| | | | | |
|---|---|---|---|---|
| 4,231,314 | A | 11/1980 | Peters | |
| 4,494,477 | A * | 1/1985 | Matthews | B63B 1/38 114/287 |
| 4,702,188 | A | 10/1987 | Harilainen | |
| 4,753,184 | A | 6/1988 | Shiavone | |
| 4,989,534 | A | 2/1991 | Field | |
| 5,452,676 | A | 9/1995 | Fiore | |
| 6,176,196 | B1 | 1/2001 | Halter | |
| 6,415,731 | B2 * | 7/2002 | Chrunyk | B63B 1/042 114/274 |
| 6,666,160 | B1 | 12/2003 | Örneblad | |
| 6,868,798 | B2 | 3/2005 | Robinson et al. | |
| 6,923,137 | B2 | 8/2005 | Waits | |
| 6,925,953 | B1 | 8/2005 | Batista et al. | |
| 6,983,713 | B1 | 1/2006 | Robinson et al. | |
| 7,549,385 | B2 | 6/2009 | Hansen et al. | |
| 7,677,192 | B2 | 3/2010 | Seism et al. | |
| 7,992,507 | B2 | 8/2011 | Adams | |
| 8,201,513 | B2 | 6/2012 | Hansen et al. | |
| 8,210,116 | B2 | 7/2012 | Campbell et al. | |
| 8,240,268 | B2 | 8/2012 | Hansen | |
| 8,291,850 | B1 | 10/2012 | Peters | |
| 8,761,583 | B2 | 4/2014 | Boschoff et al. | |
| 9,162,732 | B2 | 10/2015 | Torres et al. | |
| 10,246,162 | B2 | 4/2019 | Matthews | |
| 2005/0016435 | A1 | 1/2005 | Robinson et al. | |
| 2007/0039536 | A1 | 2/2007 | Kalil | |
| 2007/0245944 | A1 | 10/2007 | Scism et al. | |
| 2011/0056425 | A1 | 3/2011 | Campbell et al. | |
| 2012/0042820 | A1 | 2/2012 | Brekke | |
| 2012/0291686 | A1 | 11/2012 | Loui et al. | |
| 2014/0102349 | A1 | 4/2014 | Abella et al. | |
| 2015/0329178 | A1 | 11/2015 | Loui et al. | |
| 2019/0176937 | A1 | 6/2019 | Laird et al. | |

OTHER PUBLICATIONS

International Preliminary Report on Patentability and Written Opinion for International Application No. PCT/US2015/059508, dated May 9, 2017, 7 pages.

International Search Report and Written Opinion for International Application No. PCT/US2015/059508, dated Jan. 14, 2016—8 pages.

Teale, J., "Design a Boat: Painting, Varnishing, Antifouling", Adlard Coles Nautical, London, 2011—17 pages.

Deep Impact 300 Cabin Center Console: It Will Wow You—boats.com. downloaded at https://hwww.boats.com/reviews/deep-impact-399-cabin-center-consote-it-will-wow-you, 2019, 3 pages.

2019 HCB 65 Estrella Powere Boat, Yachtworld.com, downloaded from https://www.yachtworld.co/boats/2019/hcb-65-estrella-3241248, 2019, 4 pages.

* cited by examiner

MARINE VESSEL HULL WITH A LONGITUDINALLY-VENTED, PARTIAL-BEAM TRANSVERSE STEP

CROSS-REFERENCE TO RELATED APPLICATIONS

This application claims priority from U.S. Provisional Application Ser. No. 62/879,025, filed Jul. 26, 2019, and is a Continuation-in Part of U.S. application Ser. No. 16/851,506, filed Apr. 17, 2020, which claims priority from U.S. Provisional Application Ser. No. 62/835,650, filed Apr. 18, 2019, all of which are titled MARINE VESSEL HULL WITH A LONGITUDINALLY-VENTED, PARTIAL-BEAM TRANSVERSE STEP and are incorporated herein by reference in their entireties.

BACKGROUND OF THE INVENTION

Various boat hulls designs are known in the art with advantages and disadvantages. Hulls with transverse steps have certain performance benefits and hulls with longitudinal steps generally have a softer ride and tend to be very stable.

Certain hull designs comprising a combination of transverse steps and longitudinal steps are known, including Applicant's published U.S. application Ser. No. 15/145,866, titled MARINE VESSEL HULL WITH A LONGITUDINALLY VENTED TRANSVERSE STEP (status: allowed), and incorporated herein by reference in its entirety. Designs, such as those disclosed in the foregoing and as depicted in FIG. 10, which include one or more full-beam, longitudinally-vented transverse steps extending form the port to the starboard side of the hull, however, may be less than ideal for installations that use jet propulsion. In a jet-powered boat, it is desirable to minimize turbulence entering the water intakes for the jet propulsion system, typically located in the rear, bottom, center of the hull. For other configurations, such as for fishing boats intended for use in shallow water, it may be desired to minimize noise at the interface between the boat, water, and air at the port and starboard.

Thus, there is a continued desire in the art to design boat hulls that provide desired or optimal performance in specific situations.

SUMMARY OF THE INVENTION

One aspect of the invention comprises a marine vessel hull having at least one longitudinally-vented, partial-beam transverse step. Each longitudinally-vented, partial-beam, transverse step comprises at least one port forward longitudinal step portion connecting to a port transverse step portion and at least one starboard forward longitudinal step portion connecting to a starboard transverse step portion. The port transverse step portion extends to the port of the vessel from an intersection with the at least one port forward longitudinal step portion. The at least one port forward longitudinal step portion defines a longitudinal air pathway configured to feed air into the port transverse step portion when the hull is in motion on a body of water. The starboard transverse step portion extends to the starboard of the vessel from an intersection with the at least one starboard forward longitudinal step portion. The at least one starboard forward longitudinal step portion defines a longitudinal air pathway configured to feed air into the starboard transverse step portion when the hull is in motion on a body of water. In each partial-beam transverse step, no transverse step portion extends between the at least one port forward longitudinal step portion and the at least one starboard forward longitudinal step portion.

At least one port aft longitudinal step portion and at least one starboard aft longitudinal step portion may extend aft of the at least one longitudinally-vented, partial-beam transverse step. The respective forward and aft longitudinal step portions are preferably longitudinally aligned with one another such as to define an otherwise continuous longitudinal step extending forward and aft of the at least one partial-beam transverse step but for port and starboard discontinuities introduced by the at least one partial-beam transverse step.

Each longitudinal step portion may have a cross-sectional profile that comprises a cutout into the hull relative to a line defined by a deadrise angle of the hull, the cutout comprising a vertical rise starting from the line defined by the deadrise angle and a run tilted outwardly upward at a lesser, non-horizontal angle than the deadrise angle and that extends to an intersection with the line defined by the deadrise angle. The partial-beam, longitudinally-vented transverse step defines a plurality of longitudinally unrestricted transverse step air pathways configured to ventilate the partial-beam, longitudinally-vented transverse step from the port and starboard when the vessel is in motion on a body of water. The hull is preferably devoid of lifting strakes.

Embodiments may have any combination of partial-beam transverse steps and longitudinal steps, including embodiments with at least two longitudinally-vented, partial-beam transverse steps, or with only two longitudinally-vented, partial-beam transverse steps, with a plurality of longitudinal steps, wherein at least one longitudinally-vented, partial-beam transverse step intersects with all of the longitudinal steps or wherein at least one longitudinally-vented, partial-beam transverse step intersects with fewer than all of the longitudinal steps, with two longitudinal steps and two partial-beam transverse steps, and wherein each longitudinally-vented, partial-beam transverse step intersects with fewer than all of the longitudinal steps.

Each transverse step portion may taper from a maximum height at an outboard edge to a minimum height at an inboard edge. The maximum height of each transverse step portion may exceed the height of the longitudinal step with which the transverse step portion intersects. The transverse step portion may have a zero height at the inboard edge or a non-zero height at the inboard edge.

Another aspect of the invention comprises a marine vessel comprising at least one marine vessel hull as described herein. In preferred embodiments, the vessel comprises only a single hull, although multiple hull embodiments may also be provided.

DETAILED DESCRIPTION OF THE INVENTION

As depicted in FIGS. 1-9 and 11A-16, exemplary hull designs disclosed herein comprise connected longitudinal and transverse steps that do not extend across the full beam of the hull from starboard to port, referred to herein as "partial-beam, longitudinally-vented transverse steps." The figures are schematic in nature and are not intended to show all of the features that may or may not be present in some embodiments.

Figure 8:
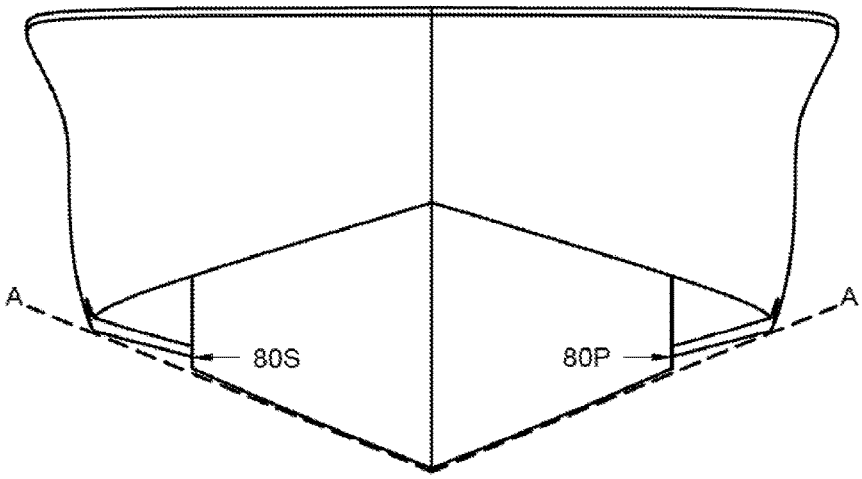
FIG. 8 is a perspective view of the exterior of the exemplary hull design of FIG. 1 as viewed from a position slightly forward of the bow looking toward the stern.

Longitudinally-vented transverse steps not only allow air to be channeled from the sides of the transverse steps but also rammed from the longitudinal steps forward of the transverse steps, thus greatly increasing air volume feeding into the transverse steps. Unlike longitudinal lifting strakes, which have cross-sectional profiles that extend laterally away from the line defined by the deadrise angle of the hull in cross section, longitudinal steps have cross-sectional profiles that comprise cutouts into the hull relative to the line defined by the deadrise angle. These cutouts create a pocket for air flow. The two lines marked A in FIG. 8 depict what is meant by the "line defined by the deadrise angle of the hull" in the foregoing sentence. Longitudinal steps aft of a longitudinally vented transverse step may aid in directional tracking and provide an additional pathway for air fed from the longitudinally vented transverse step.

Figure 1:
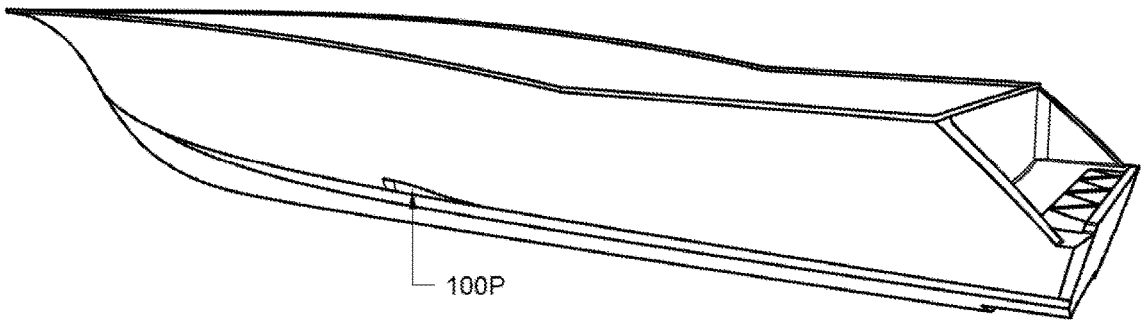
FIG. 1 is a perspective view of the exterior of an exemplary hull design as viewed from slightly above the port stern side.
Figure 2:
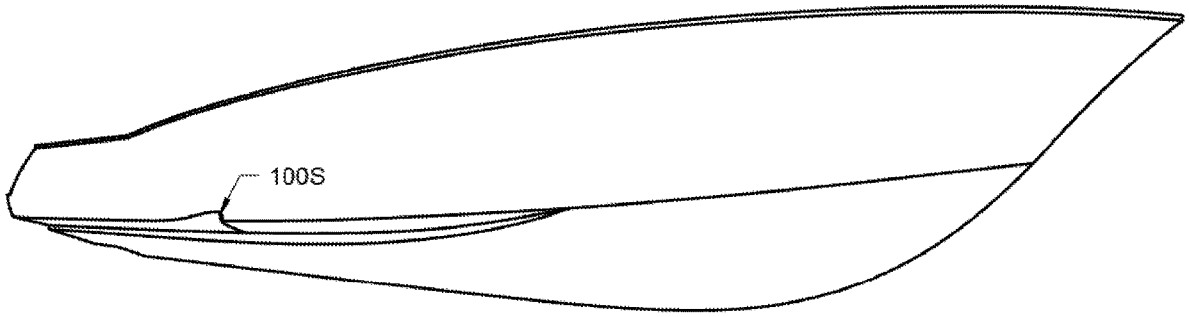
FIG. 2 is a perspective view of the exterior of the exemplary hull design of FIG. 1 as viewed from slightly below the starboard bow side.
Figure 3:
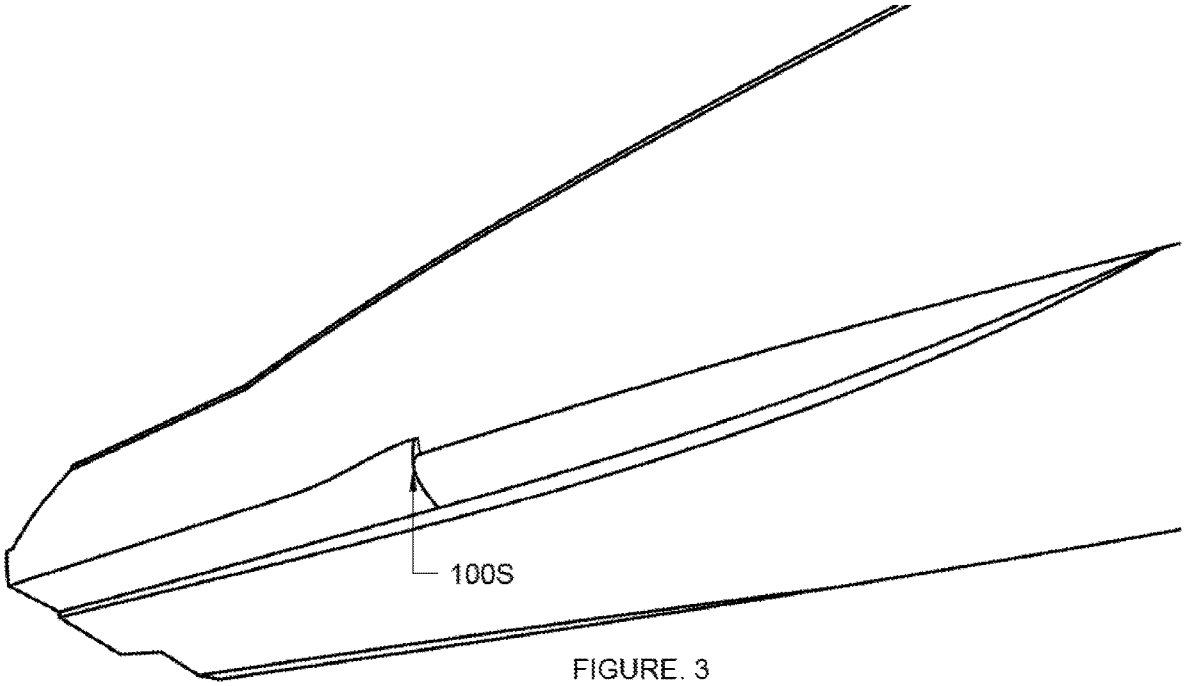
FIG. 3 is a perspective view of a portion of the exterior of the exemplary hull design of FIG. 1 as viewed from beneath and forward of the starboard portion of the partial transverse step.
Figure 4:
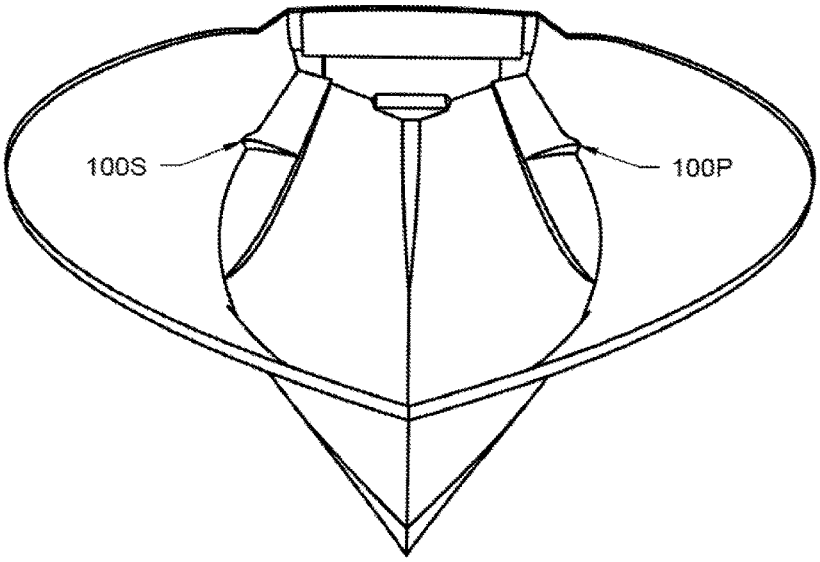
FIG. 4 is a perspective view of the interior of the exemplary hull design of FIG. 1 as viewed from slightly above the bow looking toward the stern.
Figure 5:
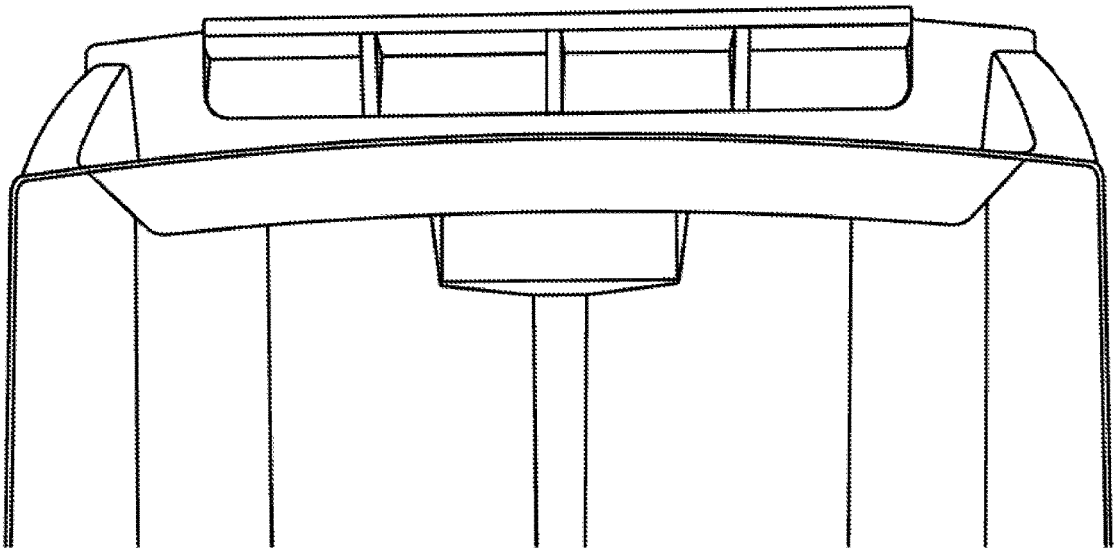
FIG. 5 is a perspective view of a stern portion of the exterior of the exemplary hull design of FIG. 1 as viewed from a position slightly forward of the stern looking down on the hull.
Figure 6:
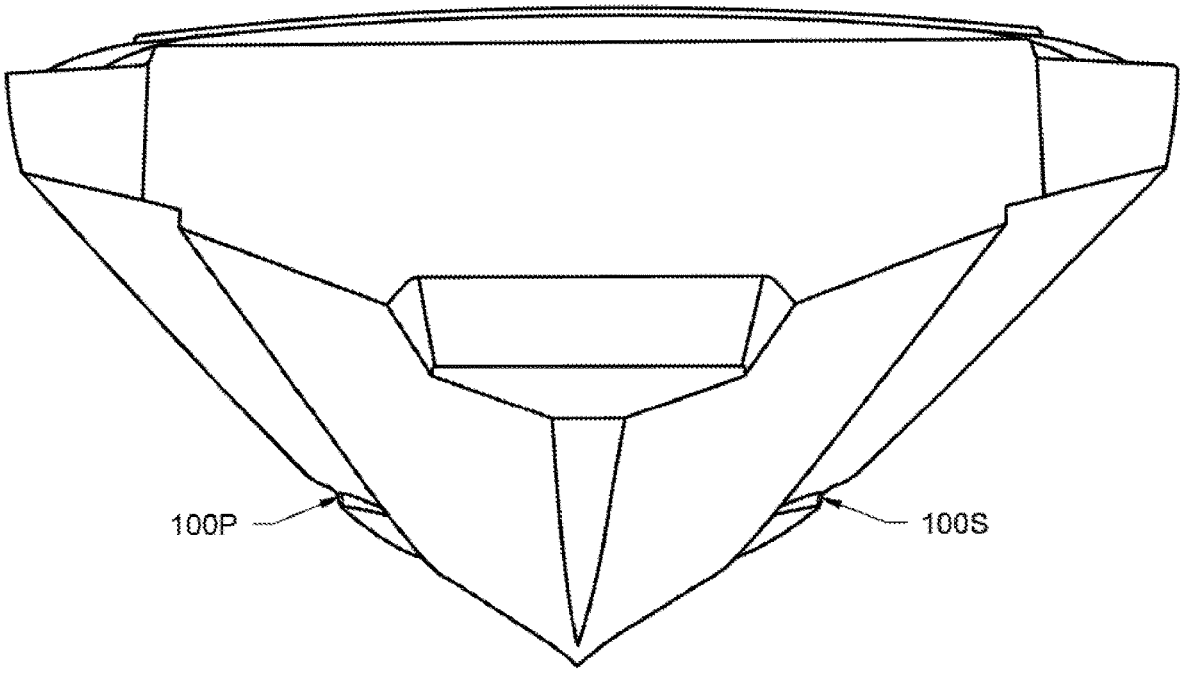
FIG. 6 is a perspective view of the exterior of the exemplary hull design of FIG. 1 as viewed from a position aft and slightly beneath the stern looking toward the bow.
Figure 7:
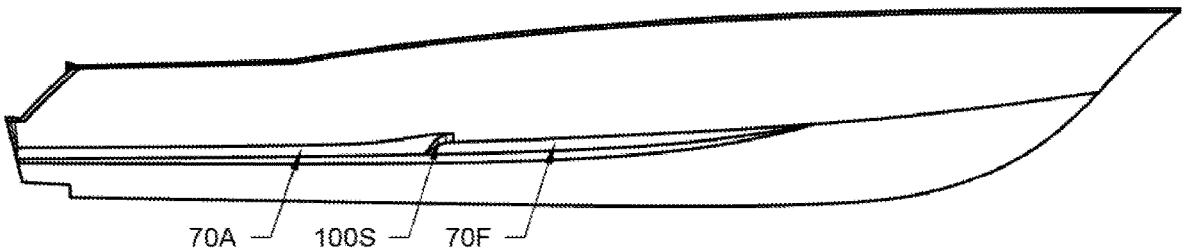
FIG. 7 is a perspective view of the exterior of the exemplary hull design of FIG. 1 as viewed from the starboard side.

In the embodiment illustrated in FIGS. 1-9 and 11A-11G, the hull comprises a single longitudinal step, each longitudinal step comprising longitudinal cutouts 80P (port portion) and 80S (starboard portion) on the port and starboard sides, respectively. As depicted, each port and starboard portion of the longitudinal step have a forward portion 70F and an aft portion 70A. The embodiment illustrated in FIGS. 1-9 also comprises a single, partial-beam, longitudinally-vented transverse step, having a port component 100P and a starboard component 100S. Although referred to herein as "longitudinally-vented, partial-beam transverse step," it should be understood that the same features may also be referred to as partial-beam-transversely-ventilated longitudinal steps. In the embodiment as depicted in FIGS. 1-9, the longitudinal step continues both forward 70F and aft 70A of the discontinuity introduced by the transverse step. Thus, as depicted in FIG. 1, the longitudinal step comprises port portion 80P and starboard portion 80S, each with forward portion 70F and aft portion 70A, and the partial-beam transverse step comprises both a port 100P transverse step portion and a starboard 100S transverse step portion.

Thus, each partial-beam, longitudinally-vented transverse step, as defined herein, comprises a port forward longitudinal step portion connecting to a port transverse step portion and a starboard forward longitudinal step portion connecting to a starboard transverse step portion. The port transverse step portion extends to the port of the vessel from an intersection with the port forward longitudinal step portion and the starboard transverse step portion extends to the starboard of the vessel from an intersection with the starboard forward longitudinal step portion. No transverse step portion extends between the port forward longitudinal step portion and the starboard forward longitudinal step portion.

Figure 9:
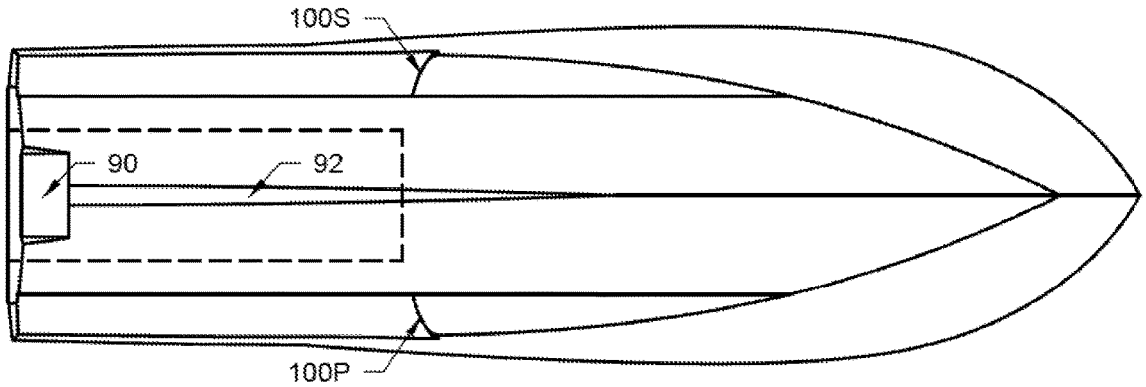
FIG. 9 is a perspective view of the exterior of the exemplary hull design of FIG. 1 as viewed from a position beneath the hull.
Figure 10:
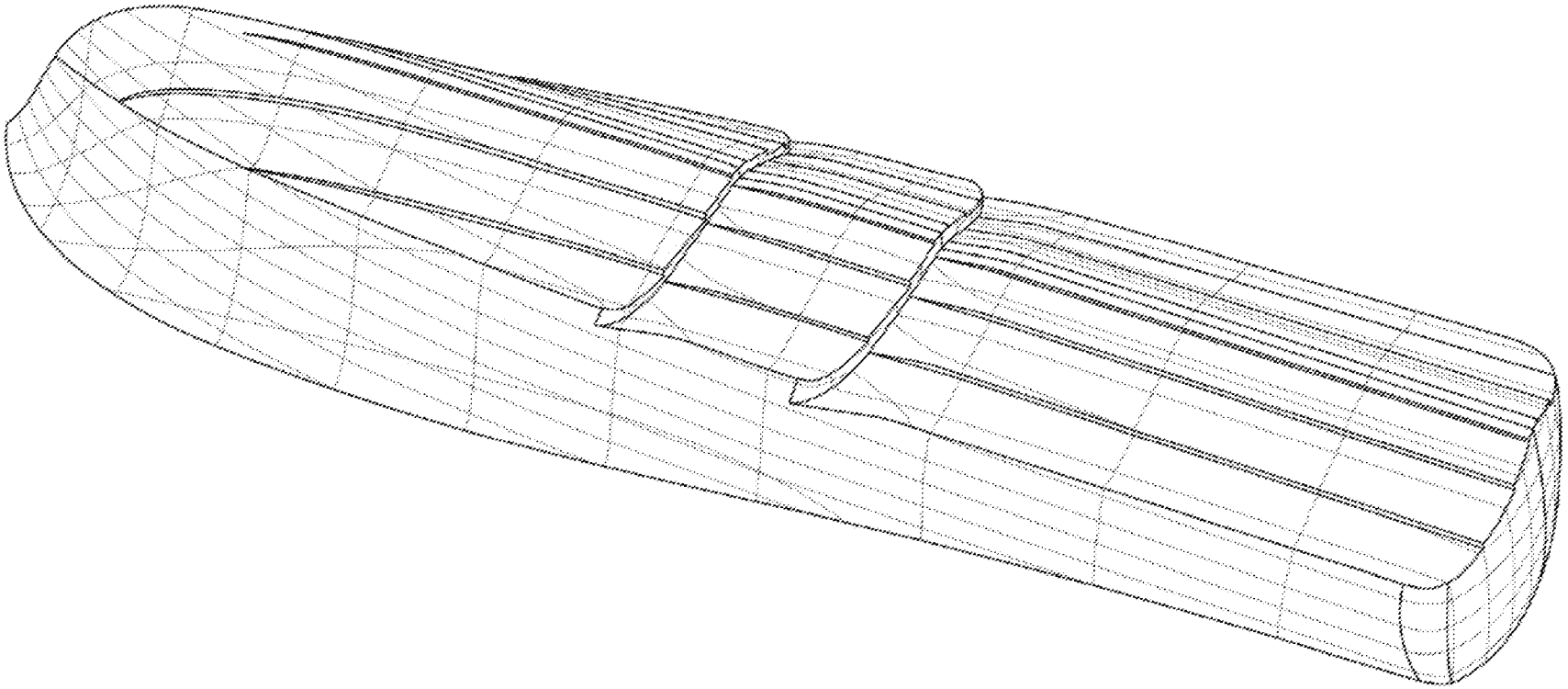
FIG. 10 (PRIOR ART)
FIG. 10 is a perspective view of the a prior art hull design as viewed from a starboard, aft, underside position, showing two full-beam, longitudinally-vented transverse steps, each having two longitudinal steps.
Figures 11A, 11B:
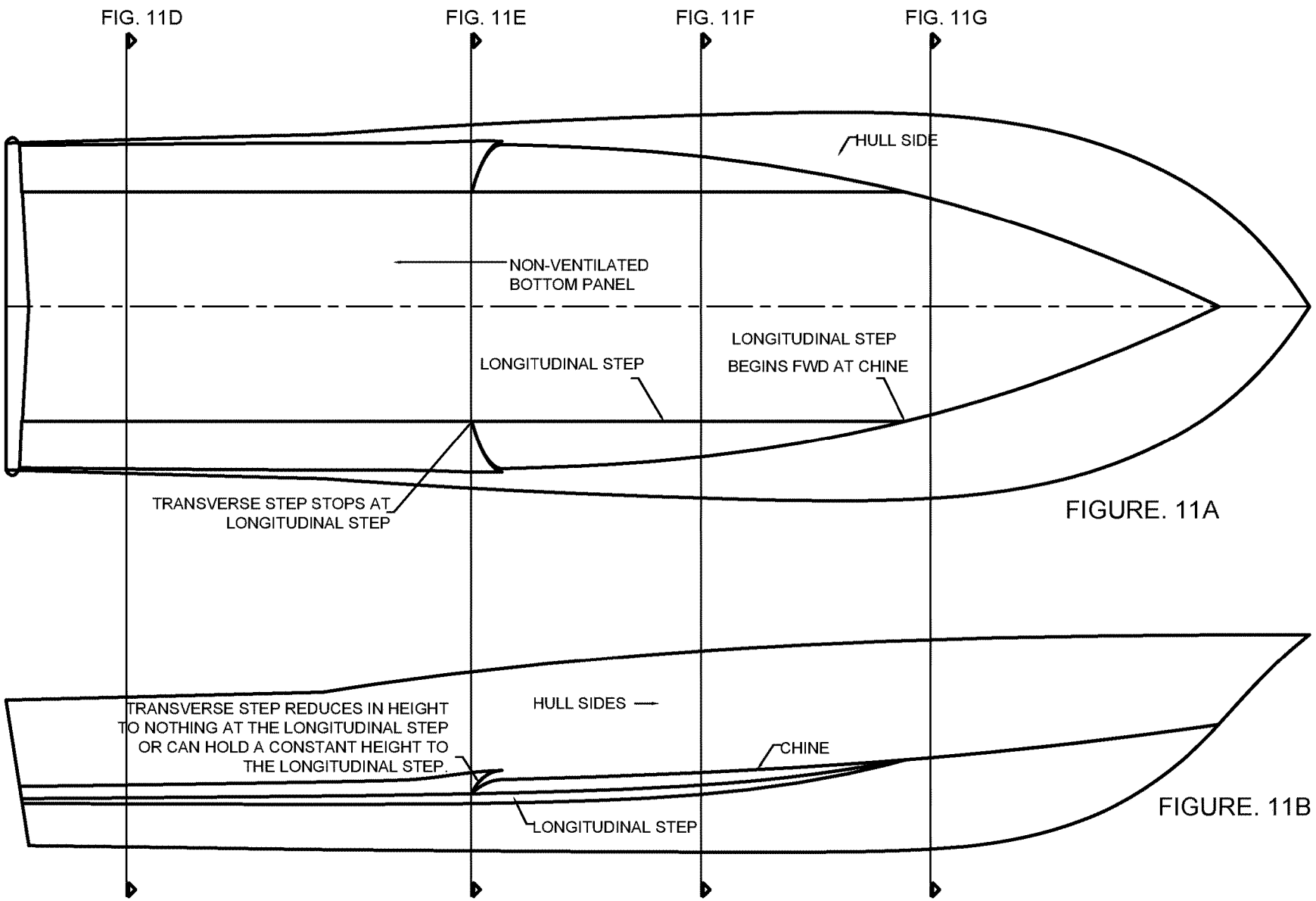
FIG. 11A is a plan view of a single, partial-beam, transversely ventilated single longitudinal step embodiment.
FIG. 11B is a starboard side view of the embodiment of FIG. 11A.
Figure 11F:
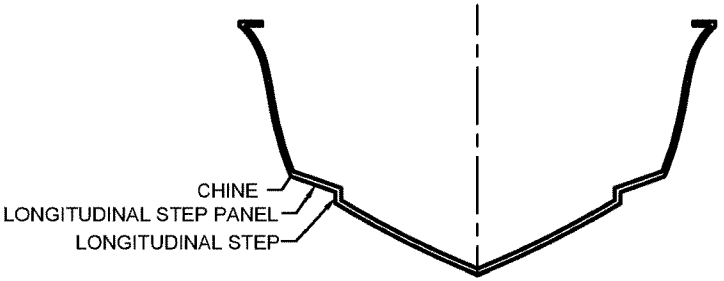
FIGS. 11D-11G are cross-sectional views of the embodiment of FIG. 11A taken across the respective lines depicted in FIGS. 11A and 11B as viewed from stern to bow.
Figure 11G:
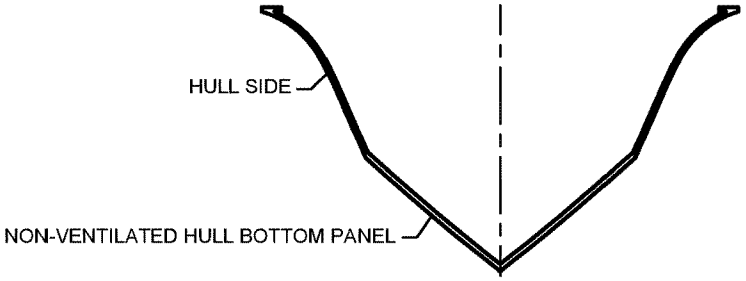
Figure 11C:
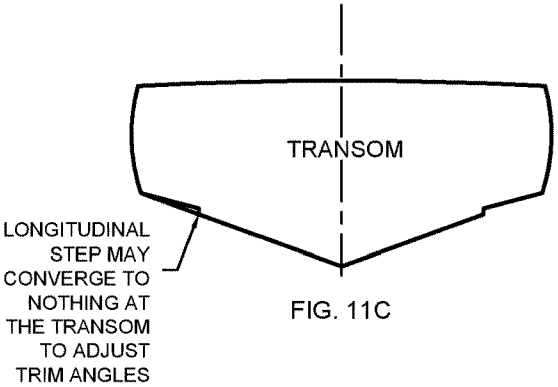
FIG. 11C is a stern view of the embodiment of FIG. 11A
Figure 11D:
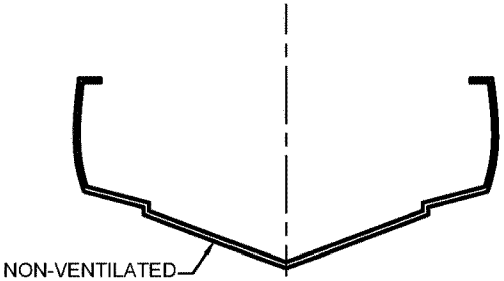
Figure 11E:
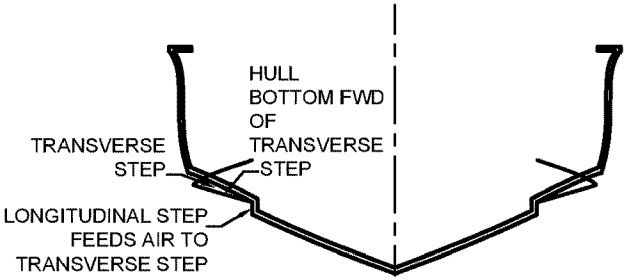

As shown, the longitudinal step may optionally also extend aft of the transverse step, but some embodiments may only have forward longitudinal step portions. Although depicted in FIGS. 1-9 and 11A-G with only a single partial-beam, longitudinally-vented transverse step (having port and starboard portions), it should be understood that other embodiments may have a plurality of transverse steps, such as depicted in FIGS. 12A-13G. Each longitudinal step defines a panel extending forward from the transom to an intersection with the chine adjacent towards the bow. A bottom panel extends across the bottom of the hull between innermost longitudinal steps. Although depicted in FIGS. 12A-13G with only partial transverse steps, in other embodiments with a plurality of transverse steps, fewer than all of the transverse steps may be partial-beam transverse-steps. Thus, at least one transverse step may be a "full-beam" transverse step that extends from port to starboard, as depicted in FIG. 10. As depicted in the embodiment shown in FIGS. 12A-12G, in an embodiment with multiple longitudinal steps, fewer than all of the longitudinal steps may be transversely-vented. Thus, as depicted in FIGS. 12A-G, both transverse steps comprising port and starboard portions 120P/120S, 122P/122S intersect one longitudinal step (also having port and starboard portions) 124P/124S but neither transverse step intersects longitudinal step 126P/126S. In other configurations, such as depicted in FIGS. 13A-G, each longitudinal step 130, 132 may intersect with each transverse step 134, 136.

Embodiments with more than one longitudinal step intersecting the transverse step(s) have at least one innermost inboard longitudinal step closest to the center line (e.g. step 132 in FIG. 13A), in which case, each partial-beam, longitudinally-vented transverse step (134, 136) has no transverse step portion extending between the port and starboard portions of the innermost inboard longitudinal step (i.e. across the bottom panel). As used herein, the term "inboard" refers to something relatively closer to a centerline of the vessel, and outboard refers to something relatively farther from the centerline of the vessel. In a design with multiple longitudinal steps, one or more inboard longitudinal steps may not intersect the partial-beam transverse steps, such as depicted in FIGS. 12A-12G. In designs with multiple transverse steps (partial-beam and/or full-beam) and multiple longitudinal steps, some longitudinal steps may intersect with more transverse steps than other longitudinal steps (e.g. one transverse step may intersect two longitudinal steps, and another transverse step may intersect only one longitudinal step, such as would be the case if of a double transverse step, double longitudinal step embodiment with forward transverse step portions intersecting only the outboard transverse step as depicted by, e.g. 122S, 122P intersecting only 124P in FIG. 12A, and the aft transverse step portions intersecting both the inboard and the outboard transverse step portions as depicted by, e.g. 134S, 134P intersecting both 130P and 132P in FIG. 12A).

Figures 12A, 12B:
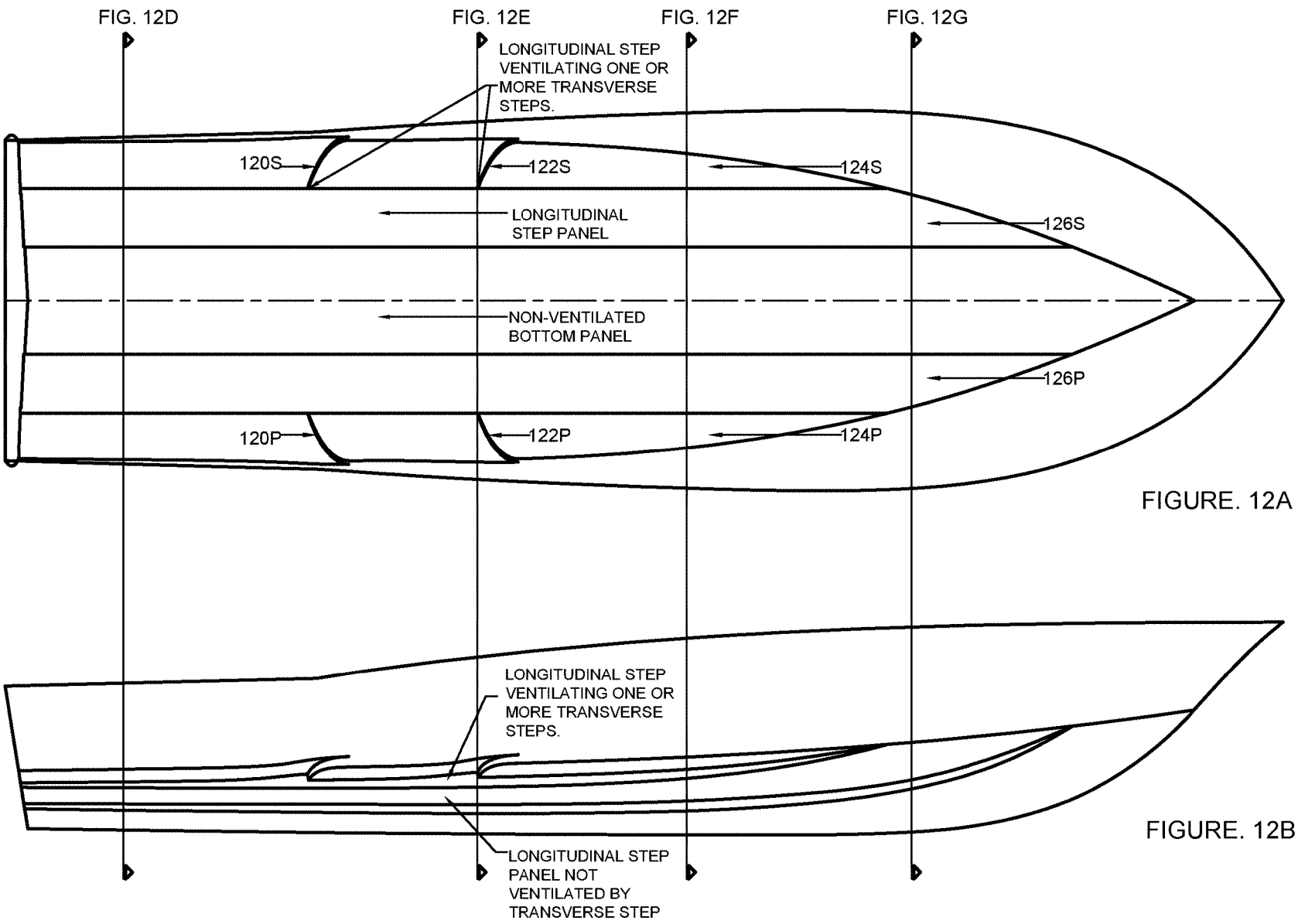
FIG. 12A is a plan view of a double, partial-beam, transversely ventilated single longitudinal step embodiment.
FIG. 12B is a starboard side view of the embodiment of FIG. 12A.
Figure 12F:
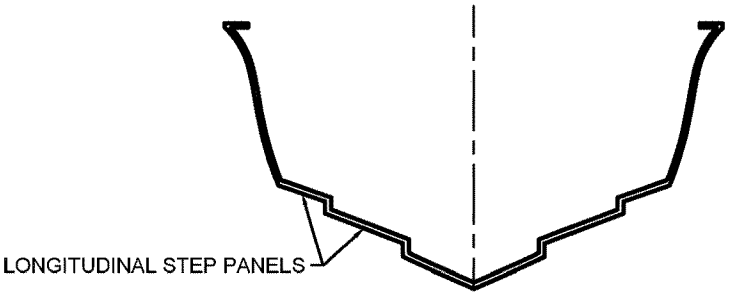
FIGS. 12D-12G are cross-sectional views of the embodiment of FIG. 12A taken across the respective lines depicted in FIGS. 12A and 12B as viewed from stern to bow.
Figure 12G:
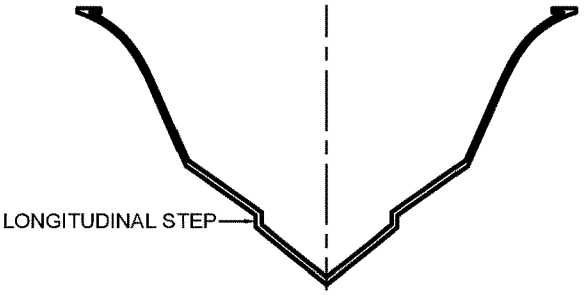
Figure 12C:
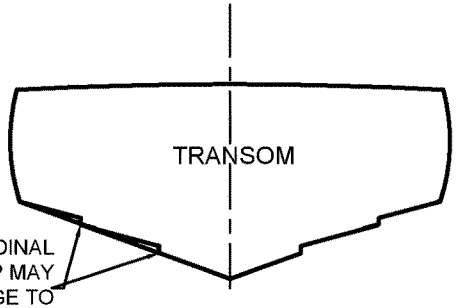
FIG. 12C is a stern view of the embodiment of FIG. 12A.
Figure 12D:
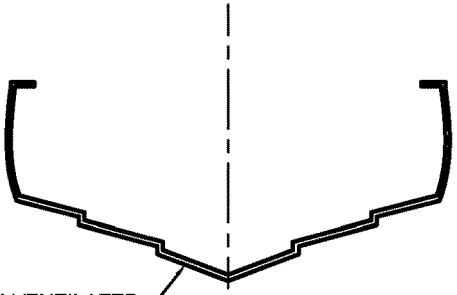
Figure 12E:
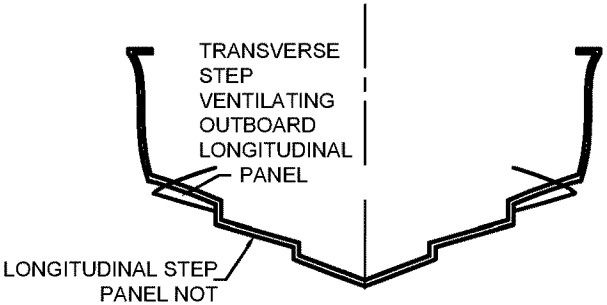
Figures 13A, 13B:
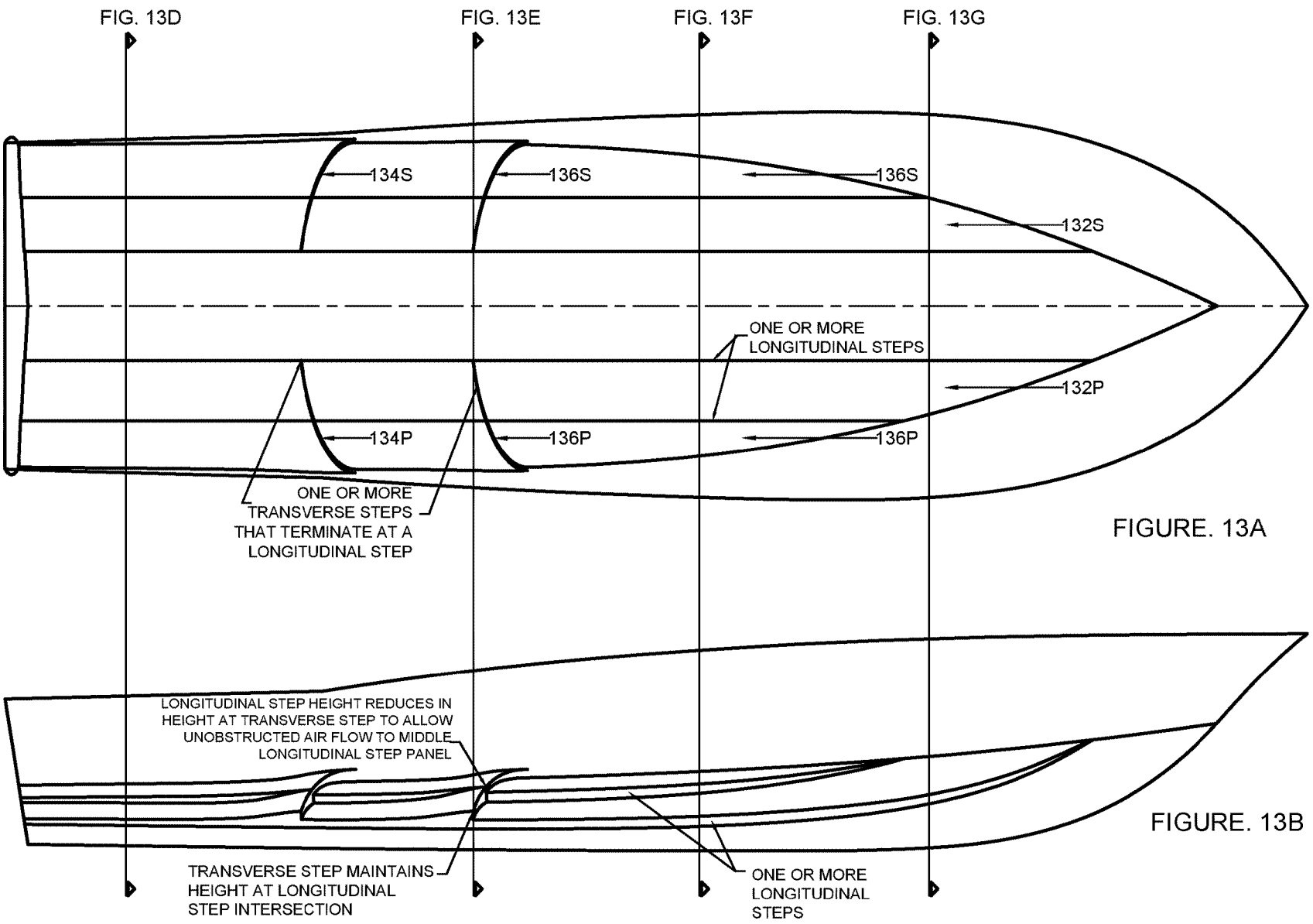
FIG. 13A is a plan view of a double, partial-beam, transversely ventilated double longitudinal step embodiment.
FIG. 13B is a starboard side view of the embodiment of FIG. 13A.
Figure 13F:
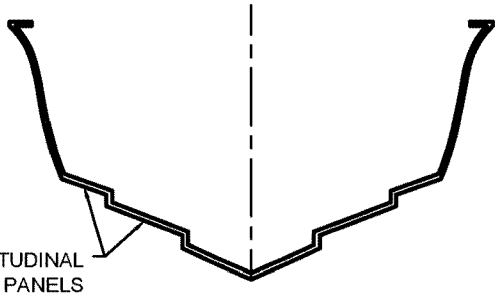
FIGS. 13D-13G are cross-sectional views of the embodiment of FIG. 13A taken across the respective lines depicted in FIGS. 13A and 13B as viewed from stern to bow.
Figure 13G:
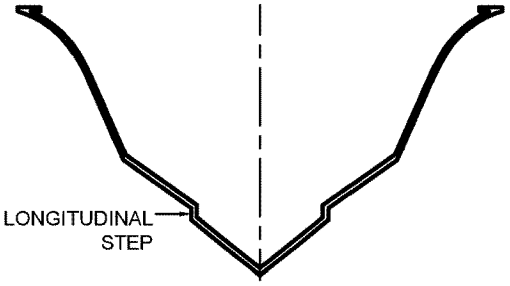
Figure 13C:
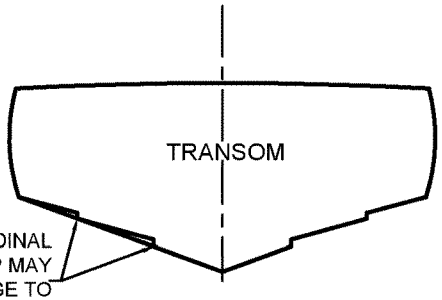
FIG. 13C is a stern view of the embodiment of FIG. 13A.
Figure 13D:
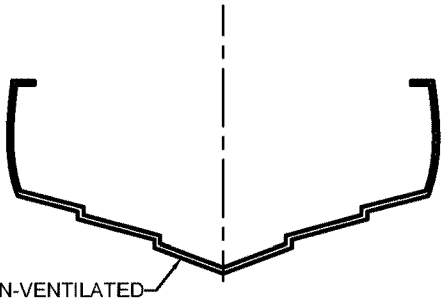
Figure 13E:
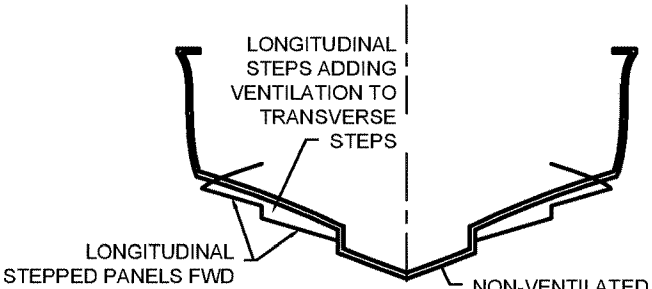

The longitudinal steps aft of the aft-most transverse step may converge (i.e. their depth [sometimes also referred to as their height] reduces in size) at the aft, meaning that they have a first, relatively-greater depth in one portion of the vessel located forward of the aft and a second, relatively-lesser depth at the aft. The transverse step may have a height that tapers from maximum height at the intersection with the chine to a minimum height (and in some embodiments, such as depicted in FIG. 12B, a zero height) at the inboard edge of the transverse step. In some embodiments, such as is shown, for example, in FIGS. 12A and 12B, the height of the transverse step at the chine may be greater than the height of the outermost ("outboard") longitudinal step panel. In some embodiments, such as the double transversely-ventilated, double longitudinal step configuration depicted in FIGS. 13A-G, the outboard longitudinal step may be reduced in height at the intersection with the transverse step to permit unobstructed air flow to the inboard longitudinal step, whereas the transverse step portion has a non-zero height at the intersection with the inboard longitudinal step, as depicted in FIG. 13B, at the intersections of 130S, 132S and 136S.

The degree of extension forward of the longitudinal step associated with a longitudinally vented transverse step is not limited to any particular length. In some embodiments, the longitudinal steps may converge forward to a zero depth, preferably along an "S" curve, such as to provide an air channel that is less restricted than would arise from continuing the longitudinal steps into, for example, the aft side of a transverse step located forward of the longitudinal step. The longitudinal steps may also be reintroduced gradually aft of the discontinuity caused by each transverse step, rather than abutting the transverse step.

Each partial-beam transverse step and its connected one or more longitudinal steps defines a set of air pathways along the longitudinal step(s) that feed(s) air into the partial-beam transverse step when the marine vessel is in motion on a body of water. The transverse step feeds the air into an air layer below the hull of the vessel aft of the transverse step. Because the transverse step does not extend from port to starboard, the air layer does not extend along the region 92 surrounding the centerline of the hull aft of the transverse step (as depicted in FIG. 9), making the partial-beam transverse step design particularly suitable for vessels that use a jet propulsion system, in which the jet intakes may be located within the non-aerated region 92. As shown in, for example, FIG. 9, a cutout may be present at the stern that extends from the bottom of the hull vertically upward.

Figures 14A, 14B:
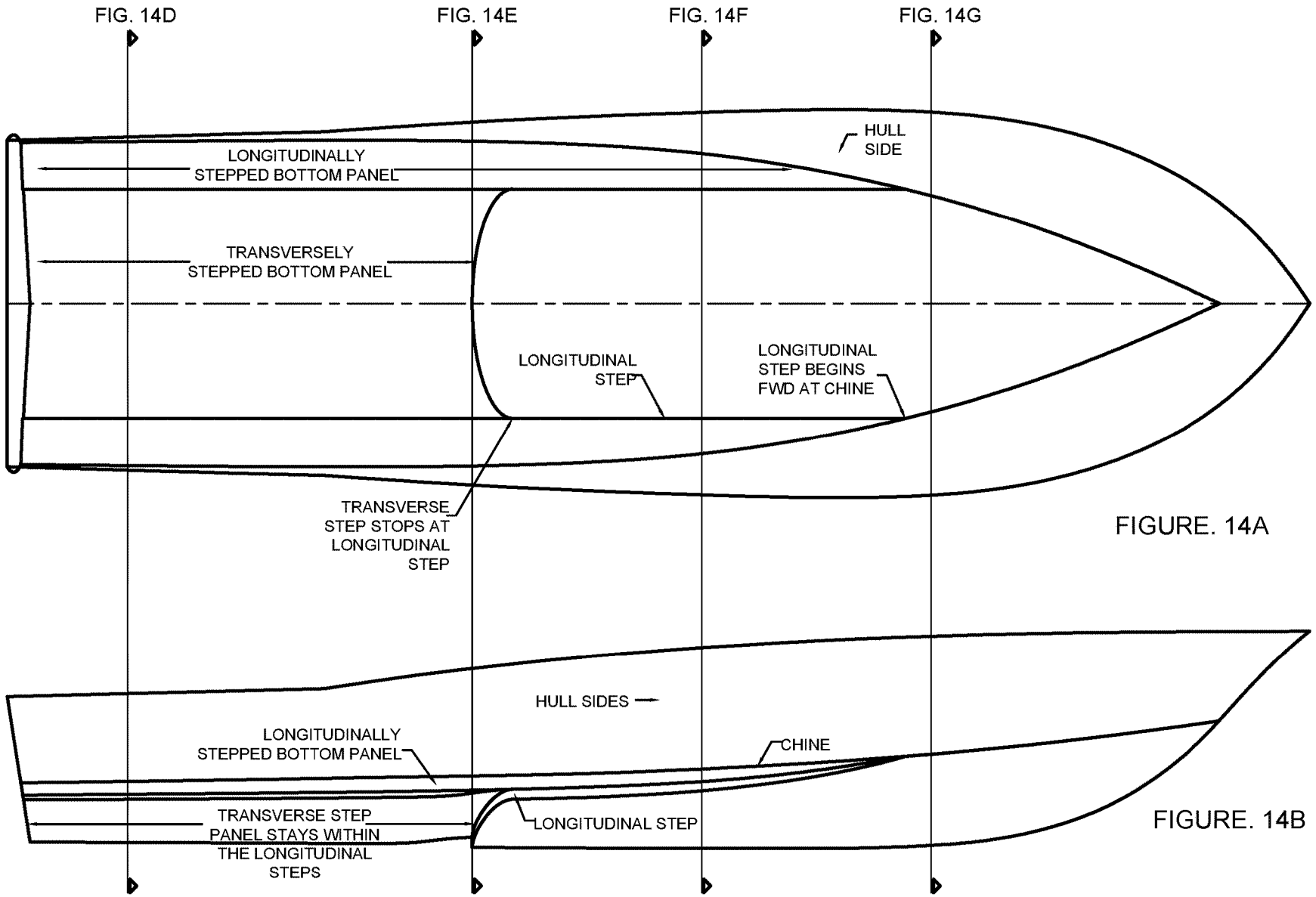
FIG. 14A is a plan view of a center-only, partial-beam, transversely ventilated single longitudinal step embodiment.
FIG. 14B is a starboard side view of the embodiment of FIG. 14A.
Figure 14F:
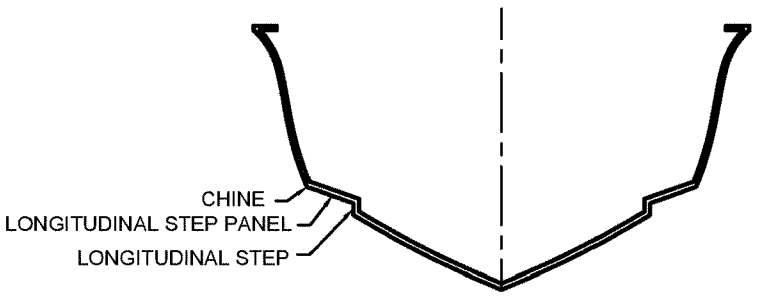
FIGS. 14D-14G are cross-sectional views of the embodiment of FIG. 14A taken across the respective lines depicted in FIGS. 14A and 14B as viewed from stern to bow.
Figure 14G:
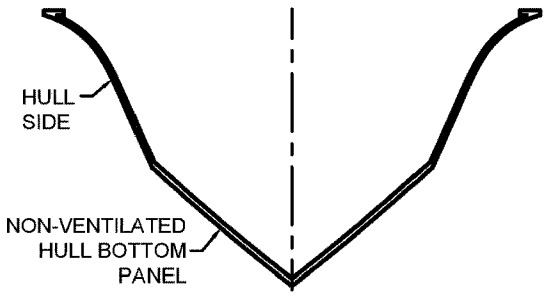
Figure 14C:
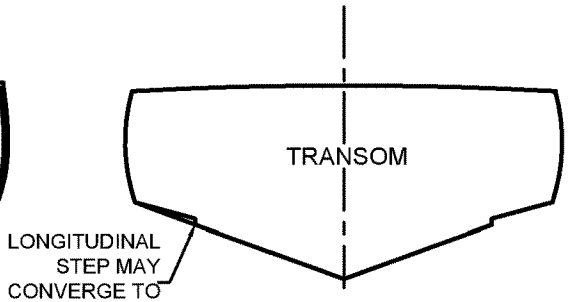
FIG. 14C is a stern view of the embodiment of FIG. 14A.
Figure 14D:
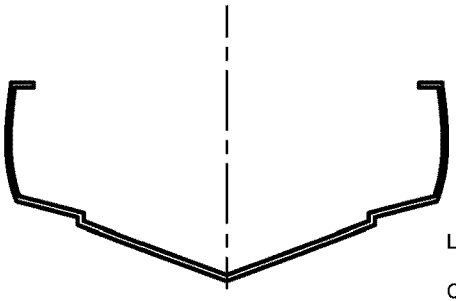
Figure 14E:
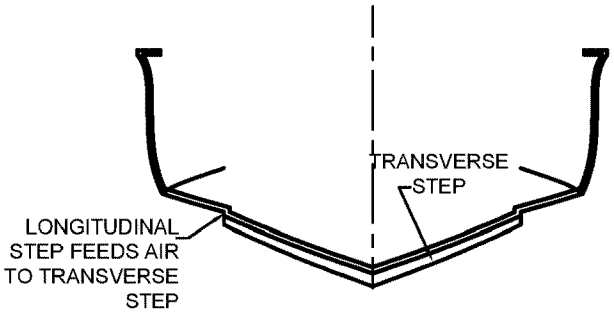

In the embodiment depicted in FIGS. 14A-14G, another configuration of the partial-beam, longitudinally-vented transverse step may extend only between the inner edges of the port and starboard longitudinal steps (e.g. extending across the centerline, but not extending to the port or starboard chine). The partial-beam, longitudinally-vented transverse step of this embodiment can be characterized as having a port transverse step portion extending from the centerline to an intersection with the longitudinal step at the port, and a starboard transverse step portion extending from the centerline to an intersection with the longitudinal step at the starboard. Such a design may be well suited for a flats skiff or any type of vessel that would benefit from quiet operation while stalking fish. A step above the waterline risks causing a slap that will spook skittish fish even with the boat at rest, so the design preferably keeps the steps below the waterline. Although longitudinal steps are unlikely to cause as much noise as a transverse step at the waterline, it may be further beneficial to converge the longitudinal steps to nothing at the transom before they leave the water as well, as depicted in FIG. 14C. While only a single, center, partial-beam longitudinally-vented transverse step is depicted in FIGS. 14A-14G, designs with multiple center, partial-beam longitudinally-vented transverse steps may also be provided. Likewise, although only a single longitudinal step is depicted, multiple longitudinal steps may be present, and the transverse step may extend between outermost longitudinal steps, innermost longitudinal steps (or intermediate longitudinal steps, if more than two), and combinations of multiple transverse steps and longitudinal steps may include one transverse step that extends between the port and starboard edges of one longitudinal step and another transverse step that extends between the port and starboard edges of another longitudinal step. Although depicted with forward and aft longitudinal step portions, embodiments with only a forward longitudinal step portion may be provided. The forward and aft longitudinal step portions are preferably aligned with one another fore and aft of the transverse step, as depicted in FIG. 14A.

Figure 15:
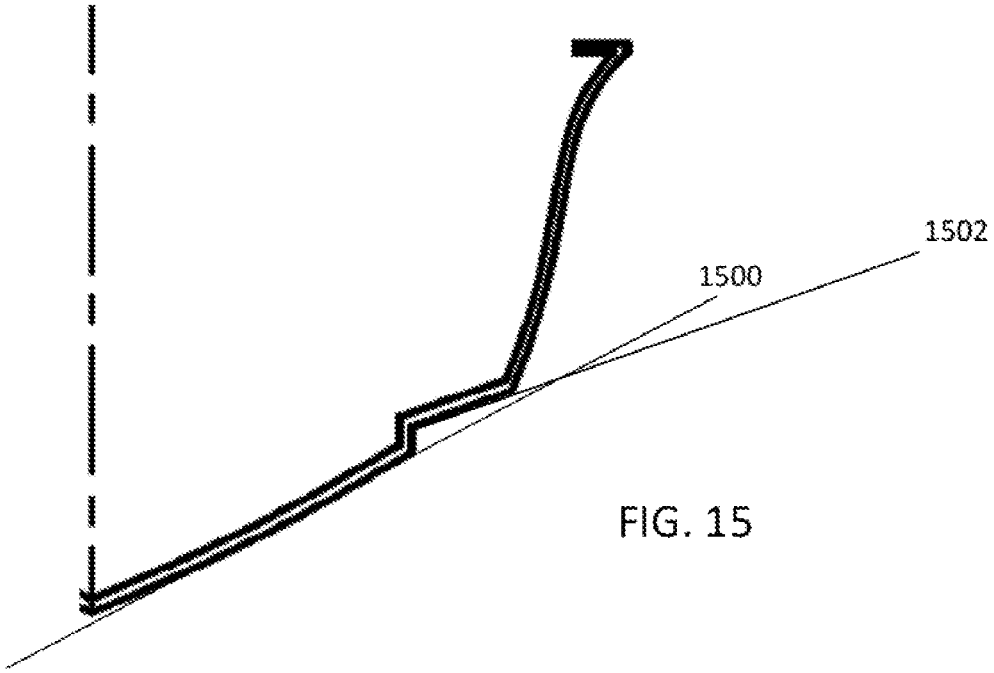
FIG. 15 depicts a starboard portion of FIG. 14F relative to the deadrise angle and a line that defines the cross section of the longitudinal steps.
Figure 16:
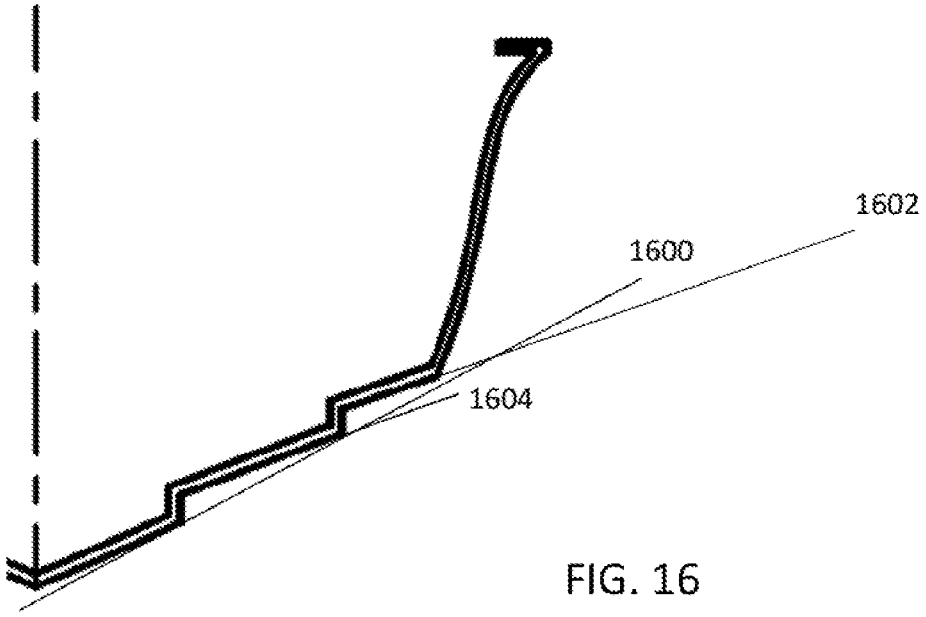
FIG. 16 depicts a starboard portion of FIG. 13F relative to the deadrise angle and lines that define the cross section of the longitudinal steps.
Figure 17A:
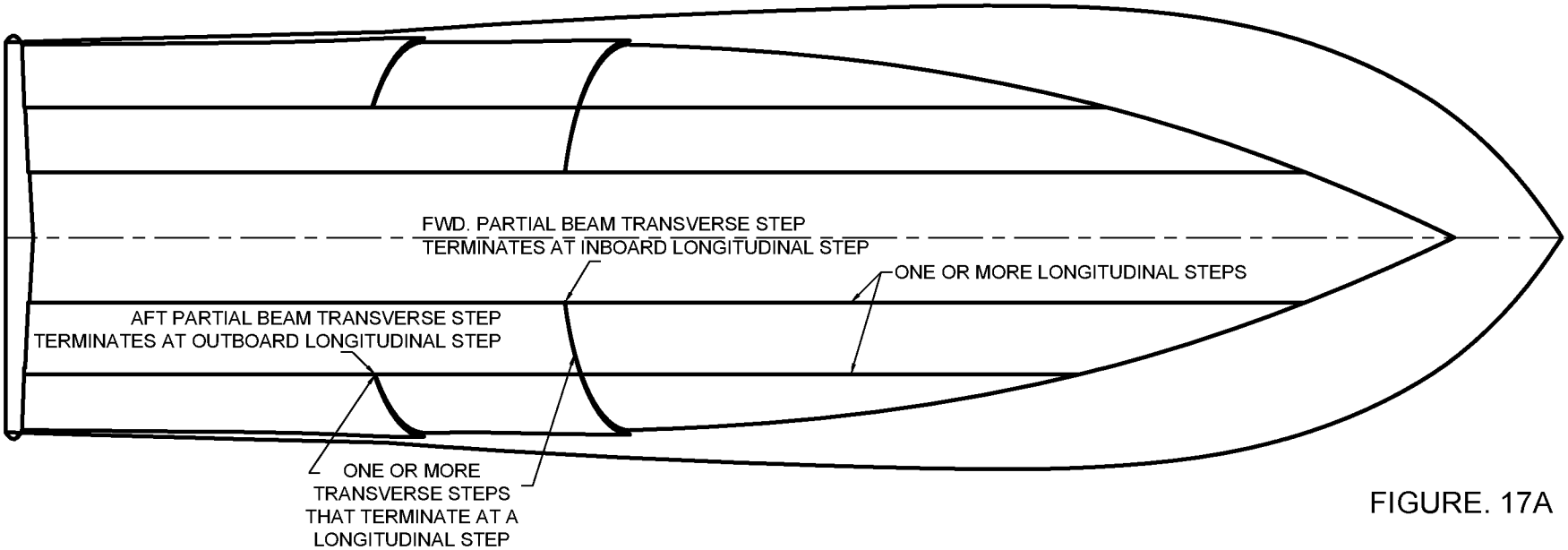
FIG. 17A is a plan view of a partial-beam, transversely ventilated double longitudinal step embodiment in which one of the plurality of longitudinally-vented, partial-beam transverse steps intersects with more longitudinal steps than another of the plurality of longitudinally-vented, partial-beam transverse steps.
Figure 17B:
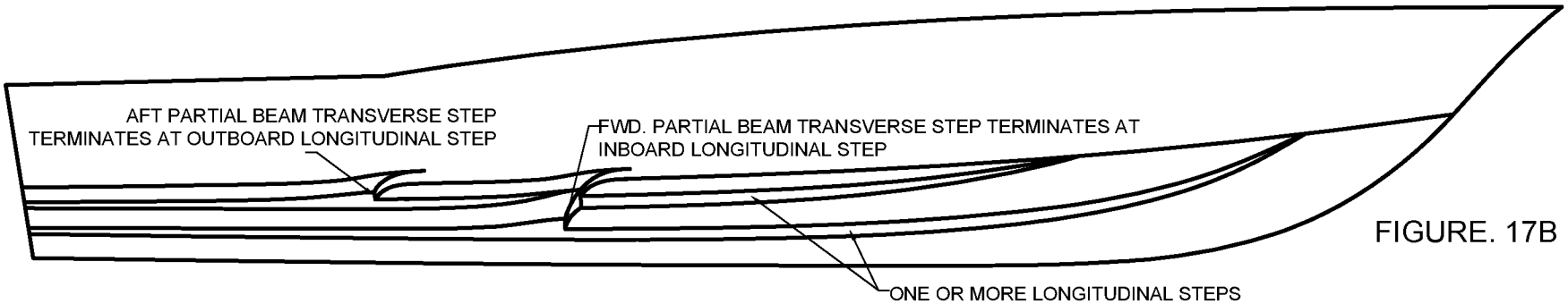
FIG. 17B is a starboard side view of the embodiment of FIG. 14A.

As depicted in FIG. 15 (depicting the starboard portion of FIG. 14F) and FIG. 16 (depicting the starboard portion of FIG. 13F), the partial-beam, longitudinally-vented transverse step embodiments as described and shown herein in all of the figures include longitudinal step portions having a cross-sectional profile that comprises a cutout into the hull relative to a line defined by a deadrise angle of the hull (1500, 1600), the cutout comprising a vertical rise starting from the line defined by the deadrise angle and a run defined by a line (1502, 1602, 1604) tilted outwardly upward at a lesser, non-horizontal angle than the deadrise angle and that extends to an intersection with the line 1500, 1600 defined by the deadrise angle.

The hull depicted herein comprises a non-entrapment hull having no amas or retaining rails or other structures extending downward into the water relative to the line defined by the deadrise angle of the hull. This non-entrapment design, characterized by an absence of amas or rails, facilitates water flow having a transverse component that smoothly follows the hull along the deadrise line A in cross section, as shown in FIG. 8. An entrapment design, by contrast, by definition greatly restricts, if not eliminates entirely, any transverse component of the water flow relative to the hull. The non-entrapment design also permits air ventilation from the port and starboard into the transverse step air channels that is longitudinally unrestricted.

Although shown here as a combination of features, the invention is not limited to any particular combination. For example, the features of the partial-beam, longitudinally-vented transverse step as discussed herein may be applicable to any type of hull shape or size. Embodiments of the invention may include boat hulls having all of the described and depicted features or fewer than all of the described and depicted features. For example, although the embodiments depicted herein are devoid of lifting strakes, and the absence of lifting strakes may have certain advantages, such as reducing vertical acceleration and reducing the chattering, pounding and human and structural fatigue associated with such vertical acceleration, other embodiments may include designs having lifting strakes or any other appendage added to the hull.

Thus, embodiments of the present invention may comprise combinations of all or fewer than all of the following features:

at least one partial-beam, longitudinally vented transverse step (i.e. one or more longitudinal steps extending forward of one or more partial-beam transverse steps);

one or more longitudinal steps extending aft of a partial-beam transverse step; and one or more longitudinal steps extending between a plurality of partial-beam transverse steps.

Although the embodiments depicted herein comprise a single partial-beam, longitudinally vented transverse step with a single longitudinally step having all of the above features, the invention is not limited to such a combination.

The boat hull designs as discussed herein may be incorporated into any type of marine vessel, but may be particularly well suited for use in sport fishing, military or performance vessels. The term marine vessel refers to any boat, yacht, or the like that is designed for travel on the surface of a body of water, including even vessels not designed for constant contact with water, such as for example, seaplanes. Similarly, the term hull refers to the portion of any such vessel that typically makes contact with the water when the vessel is normally operating in water.

Although illustrated herein in connection with a single hulled vessel, it should be understood that the hull design generally disclosed herein may be appropriate for use in connection with a multi-hull vessel, such as without limitation, a catamaran, a trimaran, or a vessel with any number of hulls known in the field in which each hull is separate and distinct from one another. When used in connection with a multi-hulled vessel, each of the multiple hulls may be identical and symmetrical, or each of the hulls may be different and asymmetrical relative to one another. For example, in a catamaran, each hull may comprise a mirror image of one another, such as a first hull essentially comprising the port half of the design of a single hull as illustrated herein, and a second hull comprising essentially the starboard half. In multi-hulled designs, each of the hulls retains its non-entrapment design. The area between the hulls, however, may or may not have an entrapment design.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A marine vessel hull having a port and a starboard, the vessel comprising at least one longitudinally-vented, partial-beam transverse step, each longitudinally-vented, partial-beam, transverse step comprising at least one port forward longitudinal step portion and at least one starboard forward longitudinal step portion:

the at least one port forward longitudinal step portion connected to a port transverse step portion, the at least one port forward longitudinal step portion defining a longitudinal air pathway configured to feed air into the port transverse step portion when the hull is in motion on a body of water; and the at least one starboard forward longitudinal step portion connected to a starboard transverse step portion, the at least one starboard forward longitudinal step portion defining a longitudinal air pathway configured to feed air into the starboard transverse step portion when the hull is in motion on a body of water;

wherein at least one longitudinally-vented, partial-beam transverse step does not continuously extend from a port chine to a starboard chine;

wherein the port transverse step portion extends to the port chine of the vessel from an intersection with the at least one port forward longitudinal step portion, the starboard transverse step portion extends to the starboard chine of the vessel from an intersection with the at least one starboard forward longitudinal step portion, and no transverse step portion extends between the at least one port forward longitudinal step portion and the at least one starboard forward longitudinal step portion; and wherein each longitudinal step portion has a cross-sectional profile that comprises a cutout into the hull relative to a line defined by a deadrise angle of the hull, the cutout comprising a vertical rise starting from the line defined by the deadrise angle and a run tilted outwardly upward at a lesser, non-horizontal angle than the deadrise angle and that extends to an intersection with the line defined by the deadrise angle.

2. The marine vessel hull of claim 1, further comprising:

at least one port aft longitudinal step portion extending aft of the at least one longitudinally-vented, partial-beam transverse step;

at least one starboard aft longitudinal step portion extending aft of the at least one longitudinally-vented, partial-beam transverse step.

3. The marine vessel hull of claim 2, wherein the at least one forward port longitudinal step portion and the at least one aft port longitudinal step portion are longitudinally aligned with one another and the at least one forward starboard longitudinal step portion and the at least one aft starboard longitudinal step portion are longitudinally aligned with one another such as to define at least one otherwise continuous longitudinal step extending forward and aft of the at least one partial-beam transverse step but for port and starboard discontinuities introduced by the at least one partial-beam transverse step.

4. The marine vessel hull of claim 2, further comprising a non-aerated region surrounding a centerline of the hull, the non-aerated region located aft of the at least one port transverse step portion, aft of the at least one starboard transverse step portion, inboard of the at least one port aft longitudinal step portion and inboard of the at least one starboard aft longitudinal step portion.

5. The marine vessel hull of claim 4, further comprising a cutout located at a stern of the hull and extending from a bottom of the hull vertically upward.

6. The marine vessel hull of claim 4, further comprising one or more air intakes for a jet propulsion system located in the non-aerated region.

7. The marine vessel hull of claim 1, wherein hull is devoid of lifting strakes.

8. The marine vessel hull of claim 1, wherein the partial-beam, longitudinally-vented transverse step defines a plurality of longitudinally unrestricted transverse step air pathways configured to ventilate the partial-beam, longitudinally-vented transverse step when the vessel is in motion on a body of water.

9. The marine vessel hull of claim 1, wherein the hull comprises a plurality of port forward longitudinal step portions and a plurality of starboard forward longitudinal step portions.

10. The marine vessel hull of claim 9, wherein the port transverse step portion of the at least one longitudinally-vented, partial-beam transverse step intersects with all of the plurality of port forward longitudinal step portions and the starboard transverse step portion of the at least one longitudinally-vented, partial-beam transverse step intersects with all of the plurality of starboard forward longitudinal step portions.

11. The marine vessel hull of claim 9, wherein the port transverse step portion of the at least one longitudinally-vented, partial-beam transverse step intersects with fewer than all of the plurality of port forward longitudinal step portions and the starboard transverse step portion of the at least one longitudinally-vented, partial-beam transverse step intersects with fewer than all of the plurality of starboard forward longitudinal step portions.

12. The marine vessel hull of claim 9, comprising a plurality of port transverse step portions and a plurality of starboard transverse step portions.

13. The marine vessel hull of claim 12, wherein one of the plurality of port transverse step portions intersects with more longitudinal steps than another of the plurality of port transverse step portions, and one of the plurality of starboard transverse step portions intersects with more longitudinal steps than another of the plurality of starboard transverse step portions.

14. The marine vessel hull of claim 1, comprising exactly two port forward longitudinal step portions, exactly two port aft longitudinal step portions, exactly two starboard forward longitudinal step portions, exactly two starboard aft longitudinal step portions, and exactly two port transverse step portions and exactly two starboard transverse step portions.

15. The marine vessel hull of claim 14, wherein each port transverse step portion intersects both port forward longitudinal step portions and both port aft longitudinal step portions each starboard transverse step portion intersects both starboard longitudinal step portions both starboard aft longitudinal step portions.

16. The marine vessel hull of claim 14, wherein each port transverse step portion intersects with only one of the port forward longitudinal step portions and only one of the port aft longitudinal step portions, and each starboard transverse step portion intersects with only one of the starboard longitudinal step portions and only one of the starboard aft longitudinal step portions.

17. The marine vessel hull of claim 1, wherein each transverse step portion of the at least one transverse step tapers from a maximum height at an outboard edge to a minimum height at an inboard edge.

18. The marine vessel hull of claim 17, wherein the maximum height of each transverse step portion exceeds a height of the longitudinal step with which the transverse step portion intersects.

19. The marine vessel hull of claim 17, wherein each transverse step portion has a zero height at the inboard edge.

20. The marine vessel hull of claim 17, wherein each transverse step portion has a non-zero height at the inboard edge.

21. The marine vessel hull of claim 1, wherein each longitudinal step converges to nothing at a transom of the vessel.

22. A marine vessel comprising at least one marine vessel hull of claim 1.

23. The marine vessel of claim 22, wherein the vessel comprises only a single hull.

24. A marine vessel hull having a port and a starboard, the vessel comprising at least one longitudinally-vented, partial-beam transverse step, each longitudinally-vented, partial-beam, transverse step comprising at least one longitudinal step, each longitudinal step comprising at least one port forward longitudinal step portion and at least one starboard forward longitudinal step portion:

the at least one port forward longitudinal step portion connected to a port transverse step portion, the at least one port forward longitudinal step portion defining a longitudinal air pathway configured to feed air into the port transverse step portion when the hull is in motion on a body of water; and port transverse step portion the at least one starboard forward longitudinal step portion connected to a starboard transverse step portion, the at least one starboard forward longitudinal step portion defining a longitudinal air pathway configured to feed air into the starboard transverse step portion when the hull is in motion on a body of water;

wherein at least one longitudinally-vented, partial-beam transverse step does not continuously extend from a port chine to a starboard chine;

wherein the at least one longitudinally-vented, partial-beam transverse step extends between an intersection with the at least one port forward longitudinal step portion and an intersection with the at least one starboard forward longitudinal step portion, but does not extend to the port chine of the vessel from the intersection with the at least one port forward longitudinal step portion or to the starboard chine from the intersection with the at least one starboard forward longitudinal step portion; and wherein each longitudinal step portion has a cross-sectional profile that comprises a cutout into the hull relative to a line defined by a deadrise angle of the hull, the cutout comprising a vertical rise starting from the line defined by the deadrise angle and a run tilted outwardly upward at a lesser, non-horizontal angle than the deadrise angle and that extends to an intersection with the line defined by the deadrise angle.

25. The marine vessel hull of claim 24, comprising exactly one port forward longitudinal step portion, exactly one port aft longitudinal step portion, exactly one starboard forward longitudinal step portion, exactly one starboard aft longitudinal step portion and exactly one partial-beam transverse step.

26. The marine vessel hull of claim 24, further comprising:

at least one port aft longitudinal step portion extending aft of the at least one longitudinally-vented, partial-beam transverse step;

at least one starboard aft longitudinal step portion extending aft of the at least one longitudinally-vented, partial-beam transverse step.

27. The marine vessel hull of claim 26, wherein the at least one forward port longitudinal step portion and the at least one aft port longitudinal step portion are longitudinally aligned with one another and the at least one forward starboard longitudinal step portion and the at least one aft starboard longitudinal step portion are longitudinally aligned with one another such as to define at least one otherwise continuous longitudinal step extending forward and aft of the at least one partial-beam transverse step but for port and starboard discontinuities introduced by the at least one partial-beam transverse step.

28. The marine vessel hull of claim 24, wherein hull is devoid of lifting strakes.

29. The marine vessel hull of claim 24, wherein the partial-beam, longitudinally-vented transverse step defines a plurality of longitudinally unrestricted transverse step air pathways configured to ventilate the partial-beam, longitudinally-vented transverse step when the vessel is in motion on a body of water.

30. The marine vessel hull of claim 24, comprising exactly one port longitudinal step portion and exactly one starboard longitudinal step portion and exactly one partial-beam transverse steps.

31. The marine vessel hull of claim 24, wherein each longitudinal step converges to nothing at a transom of the vessel.

32. A marine vessel comprising at least one marine vessel hull of claim 24.

33. The marine vessel of claim 32, wherein the vessel comprises only a single hull.

34. The marine vessel hull of claim 24, wherein the at least one longitudinally-vented, partial-beam transverse step is located entirely below a waterline of the marine vessel hull.

* * * * *